US012716216B2

(12) United States Patent
Cheng

(10) Patent No.: US 12,716,216 B2
(45) Date of Patent: Aug. 25, 2026

(54) OPERATING MECHANISM AND HOSE DRAWING DEVICE

(71) Applicant: Beijing Kohler Ltd., Beijing (CN)

(72) Inventor: Guang Cheng, Beijing (CN)

(73) Assignee: Beijing Kohler Ltd., Beijing (CN)

( * ) Notice: Subject to any disclaimer, the term of this patent is extended or adjusted under 35 U.S.C. 154(b) by 0 days.

(21) Appl. No.: 18/983,264

(22) Filed: Dec. 16, 2024

(65) Prior Publication Data

US 2025/0116096 A1 Apr. 10, 2025

Related U.S. Application Data

(63) Continuation of application No. 18/193,262, filed on Mar. 30, 2023, now Pat. No. 12,203,250.

(30) Foreign Application Priority Data

Mar. 30, 2022 (CN) ..... 202220722244.0

(51) Int. Cl.
*E03C 1/04* (2006.01)

(52) U.S. Cl.
CPC ..... *E03C 1/0403* (2013.01); *E03C 1/0404* (2013.01); *E03C 2001/0415* (2013.01)

(58) Field of Classification Search
CPC ..... E03C 1/0403; E03C 1/0404; E03C 2001/0415; Y10T 137/9464
USPC ..... 137/801, 355.23–355.25
See application file for complete search history.

(56) References Cited

U.S. PATENT DOCUMENTS

| | | | | |
|---|---|---|---|---|
| 6,915,816 | B2 * | 7/2005 | Nelson | E03C 1/04 137/355.23 |
| 6,915,817 | B2 * | 7/2005 | Benstead | E03C 1/04 137/355.25 |
| 12,203,250 | B2 * | 1/2025 | Cheng | E03C 1/0403 |
| 2007/0252022 | A1 | 11/2007 | Benstead | |
| 2020/0181892 | A1 | 6/2020 | Macsay | |

* cited by examiner

*Primary Examiner* — John Bastianelli
(74) *Attorney, Agent, or Firm* — Husch Blackwell LLP

(57) ABSTRACT

An operating mechanism and a hose drawing device, comprising a hose body, a hose guide sleeve, a mounting box, a swing arm, a button switch and a top pin. The hose guide sleeve is fitted in the hose body in the way of clearance fit, the mounting box is mounted on the outside of the hose body, the swing arm is pivotally mounted in the mounting box; an upper guide sleeve and a lower guide sleeve are provided in the mounting box. The button switch is slidably assembled in the upper guide sleeve, the top pin is slidably assembled in the lower guide sleeve, and the lower guide sleeve is provided with an elastic member for driving the top pin toward the swing arm.

19 Claims, 7 Drawing Sheets

OPERATING MECHANISM AND HOSE DRAWING DEVICE

RELATED APPLICATIONS

This application is a continuation of U.S. application Ser. No. 18/193,262 filed on Mar. 30, 2023 which also claims priority to Chinese Utility Model patent application No. 202220722244.0, filed Mar. 30, 2022, both of which are incorporated herein by reference in their entireties.

TECHNICAL FIELD

The present disclosure relates generally to the technical field of draw-out type faucets, and, specifically, to an operating mechanism and a hose drawing device.

BACKGROUND

Draw-out type faucets are often used in the sanitary industry, for example, draw-out kitchen faucets or basin faucets having a retractable hose and optional spray head. Generally, an operating mechanism is usually assembled on one side of the hose body or the housing to prevent the drawn water hose from falling back naturally. For example, an existing operating mechanism configuration can comprise a slider, a telescopic pin, a sliding pin, a ramp, and a guide member. The slider can be pushed upward by a guide sleeve on the water hose, which causes the telescopic pin to move along the ramp and extend. The sliding pin is positioned in the guide member to limit the slider to fall back and prevent the water hose from falling back by stopping the guide sleeve from falling back through the telescopic pin. When the user pulls the water hose again, the slider moves up again and the sliding pin falls along the guide member, so that the slider can fall back to the original position, and the telescopic pin moves down along the ramp and contracts, so that the water hose and the guide sleeve can fall back to the original position.

The existing operating mechanism requires a large space in the vertical direction and a complicated assembly relationship.

In view of this, it becomes necessary to provide an operating mechanism and a hose drawing device with simple structure, convenient assembly and small space occupation.

SUMMARY

The object of the application is to overcome the shortcomings of other hose drawing mechanisms and provide an operation mechanism and a hose drawing device with simple structure, convenient assembly, and small space occupation.

Non-limiting examples of the present disclosure provide an operating mechanism comprising: a hose body, a hose guide sleeve, a mounting box, a swing arm, a button switch and a top pin. The hose guide sleeve is fitted in the hose body in the way of clearance fit, the mounting box is mounted on the outside of the hose body, and the swing arm is pivotally mounted in the mounting box. The mounting box has an upper guide sleeve and a lower guide sleeve communicated with the hose body. The button switch is slidably assembled in the upper guide sleeve, one end of the button switch is in contact with the upper end of the swing arm, the other end of the button switch is located in the hose body, and the button switch can be actuated and reset by the upwardly moving hose guide sleeve. The top pin is slidably assembled in the lower guide sleeve. The top pin is in contact with the lower end of the swing arm and an elastic member for driving the top pin to move toward the swing arm is provided in the lower guide sleeve, wherein the button switch has an initial state and an actuated state. When the button switch is in the initial state, the top pin and the hose body is in a separated state and when the button switch is in the actuated state, the end of the top pin is inserted into the hose body and is capable of preventing the hose guide sleeve from falling.

In one of the optional examples, the button switch comprises a button and a slide bar slidingly connected to the button, one end of the slide bar is in contact with the upper end of the swing arm.

In examples, a limiting guide cylinder having a guide groove is fixedly mounted in the upper guide sleeve, the limiting guide cylinder has a limiting end face on an end face of the limiting guide cylinder facing the swing arm.

In examples, the button has a ring gear, the ring gear has bumps on its circumference surface, the slide bar has toggle teeth for toggling the ring gear to rotate.

In examples, the button is in a clearance fit with the limiting guide cylinder, one end of the button is located in the hose body and the toggle teeth engages with the ring gear.

In examples, when the button switch is in an initial state, the bump is fitted in the guide groove in the way of clearance fit. When the button switch is in an actuated state, the bump leaves the guide groove and is blocked by the limiting end face.

In one of the optional examples, the limiting end face is in the form of a step. The limiting end face comprises a first limiting face and a second limiting face on one side of the first limiting face, the distance between the first limiting face and the hose body is less than the distance between the second limiting face and the hose body. When the button switch is in an actuated state, the bump is blocked by the first limiting face.

In one of the optional examples, the slide bar has a slide bar plate on the end of the slide bar facing the end of the swing arm, the toggle teeth is provided on the slide bar plate, and the slide bar plate is in contact with the upper end of the swing arm.

In one of the optional examples, the number of the toggle teeth is n, and the ring gear has 2n ring gear teeth, wherein n is a positive integer.

In one of the optional examples, a plurality of the bumps is evenly distributed on the circumference surface of the ring gear, and accordingly, a plurality of the guide grooves are provided on the wall of the limiting guide cylinder, wherein the number of the bumps is being equal to the number of the guide grooves.

In one of the optional examples, the upper end of the hose guide sleeve has a tapered portion for actuating the button switch. In examples, the tapered portion has a gradually decreasing radius along the direction from bottom to top.

In one of the optional examples, the upper end of the swing arm is provided with an upper protrusion, wherein the upper protrusion is in contact with the button switch. In examples, the lower end of the swing arm is provided with a lower protrusion, wherein the lower protrusion is in contact with the top pin.

In one of the optional examples, the mounting box comprises a box body connected to the hose body and an end cap connected to the box body. The upper guide sleeve and the lower guide sleeve are located in the box body and the swing arm is mounted on the end cap through a pivot shaft.

In one of the optional examples, the end cap is connected to the box body through a snap.

Non-limiting examples of the present disclosure provides a hose drawing device, comprising a water hose and an operating mechanism as described in any of the preceding examples, wherein the hose guide sleeve is sleeved on the water hose and the water hose passes through the hose body.

For the operation mechanism and hose drawing device of the application, when the button switch is in the initial state, the top pin is separated from the hose body. When the water hose is pulled upward, the hose guide sleeve may press the button switch. The button switch moves toward the swing arm, which makes the swing arm rotate and then drives the top pin to extend toward the hose body. The button switch remains in the corresponding position, the top pin remains extended, and the falling hose guide sleeve is blocked by the top pin so as to prevent the water hose from falling back automatically. When the water hose is pulled upward again, the hose guide sleeve presses the button switch again. The button switch is reset to the initial state, and the top pin retracts and separates from the hose body under the action of the elastic member. The hose guide sleeve may fall in the hose body, and the water hose is reset.

The operating mechanism and hose drawing device of the application occupy small space, have simple structure and are easy to assemble, in which the button switch and the top pin are linked by a swing arm.

BRIEF DESCRIPTION OF THE DRAWINGS

The disclosure of the application will become more fully understood from the following detailed description, taken in conjunction with the accompanying figures. It should be understood that these figures are for illustrative purposes only and are not intended to constitute a limitation on the scope of protection of the application. In the figures.

DETAILED DESCRIPTION

Figure 1:
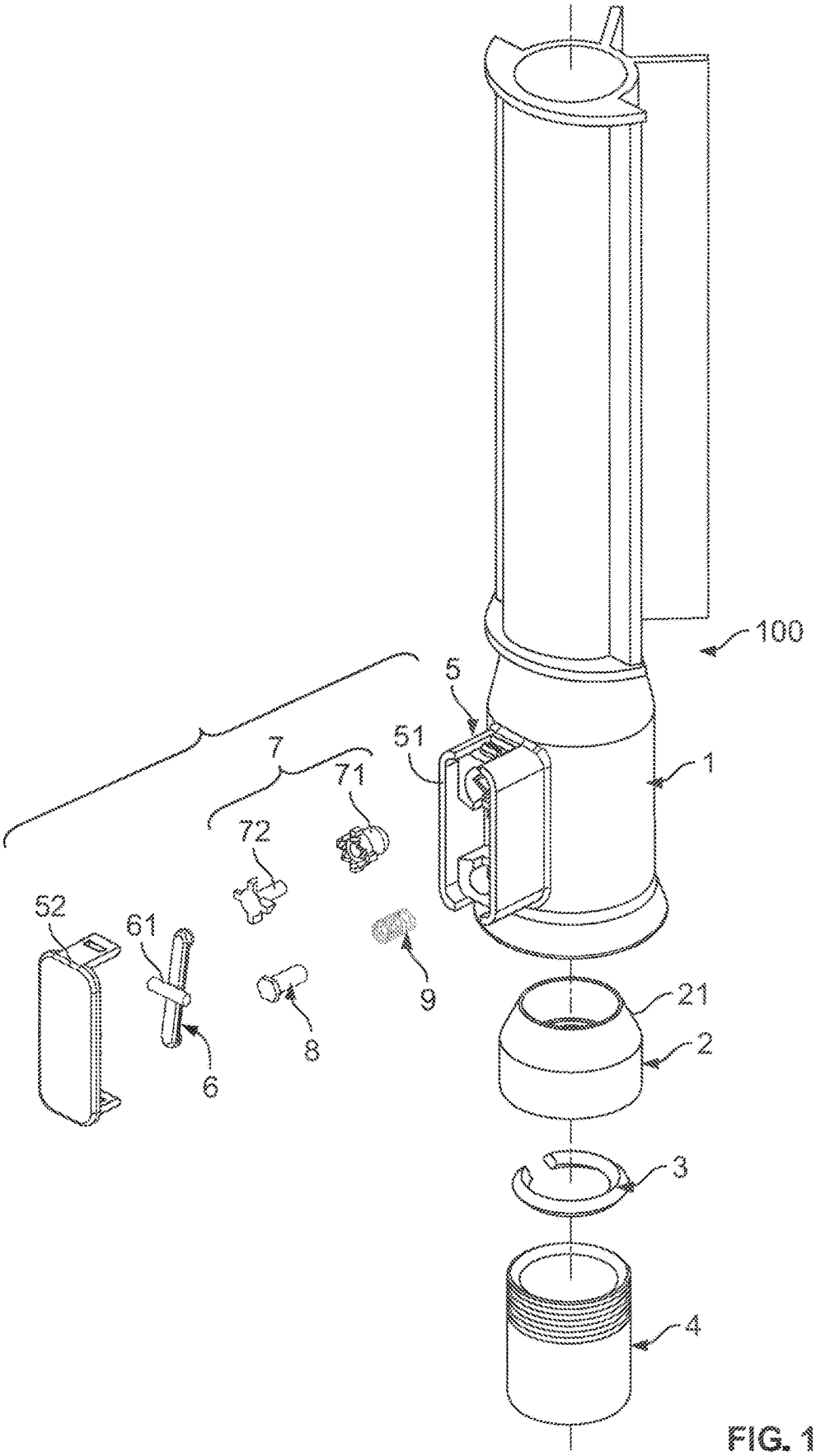
FIG. 1 is an exploded view of an operating mechanism.

Examples of the disclosure are further described below with reference to the accompanying figures, wherein like reference numerals refer to like elements. It should be noted that, terms as used in the following description, "front", "rear", "left", "right", "up" and "down" indicate a direction in the figures, and terms "inner" and "outer" respectively indicate the direction toward or away from a geometric center of a particular part.

Figure 2:
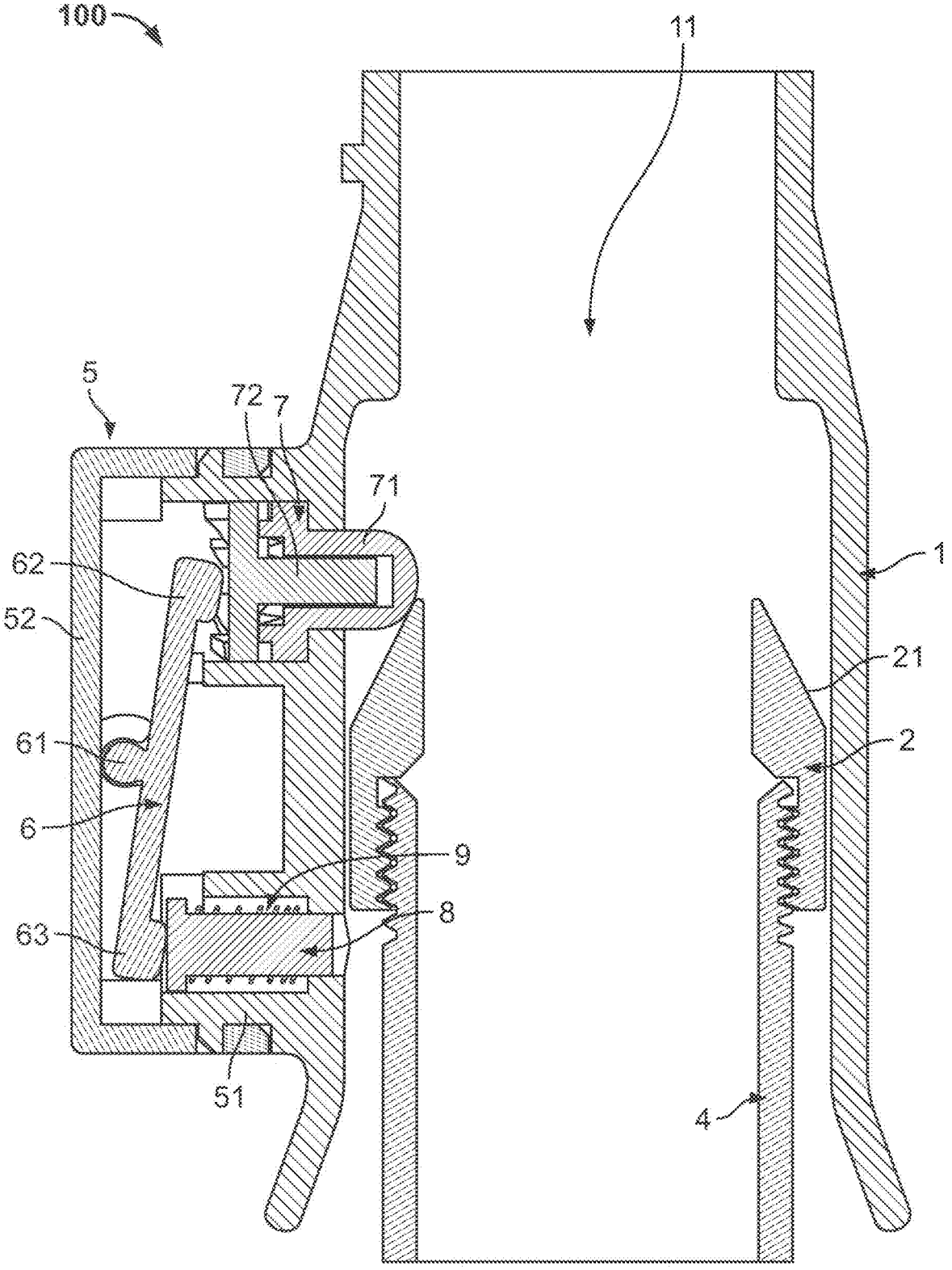
FIG. 2 is a section view of an operating mechanism.
Figure 3:
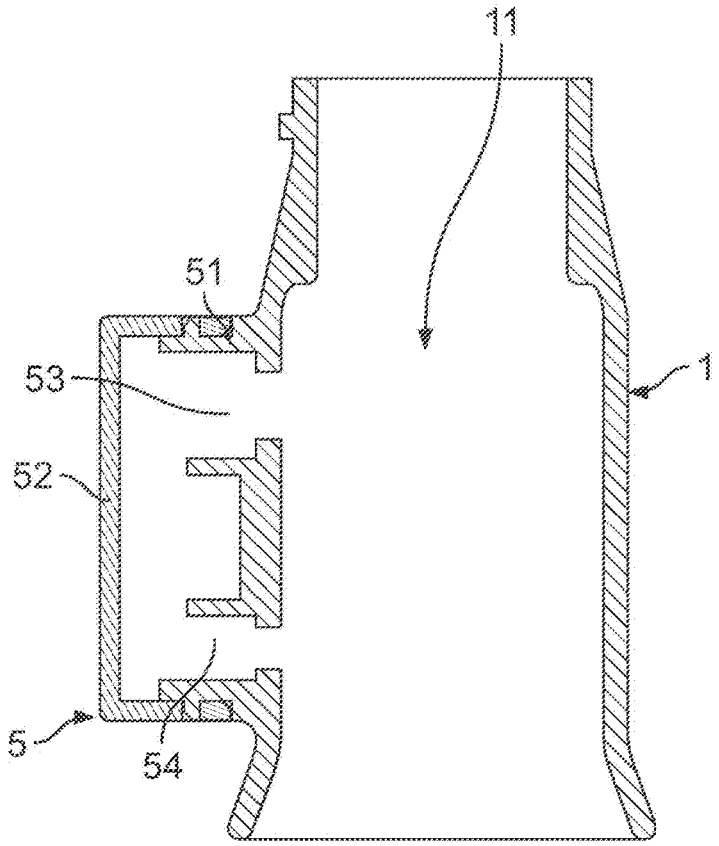
FIG. 3 is a section view of a hose body and a mounting box.
Figure 4:
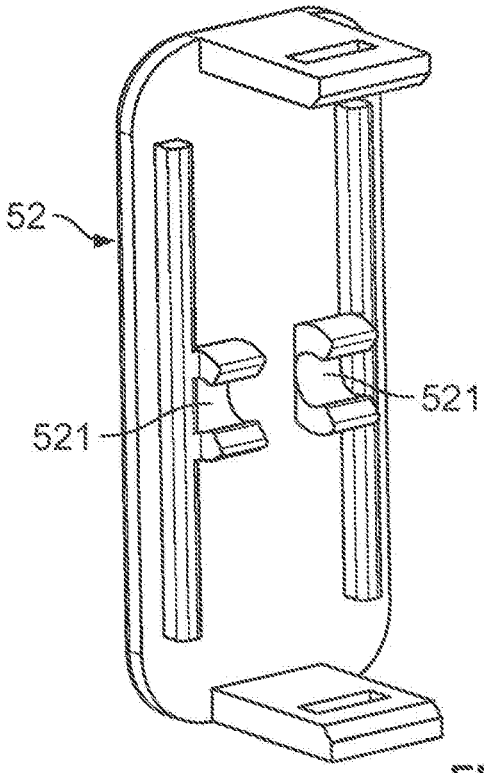
FIG. 4 is a perspective view of an end cap of a mounting box.

As shown in FIGS. 1 through 3, an example of the application provides an operating mechanism 100 comprising a hose body 1, a hose guide sleeve 2, a mounting box 5, a swing arm 6, a button switch 7, a top pin 8 and an elastic member 9.

The hose guide sleeve 2 is assembled in the hose body 1 with clearance, the mounting box 5 is mounted on the outside of the hose body 1, and the swing arm 6 is pivotally mounted in the mounting box 5. In examples, the mounting box 5 may be a box-type structure, which is coupled to one side of the hose body 1. The mounting box 5 has an upper guide sleeve 53 and a lower guide sleeve 54. The upper guide sleeve 53 and the lower guide sleeve 54 extend along the horizontal direction and are communicated with a channel 11 of the hose body 1, respectively.

The button switch 7 is slidably assembled in the upper guide sleeve 53. One end of the button switch 7 (i.e., a slide bar 72) is in contact with the upper end of the swing arm 6, and the opposing end of the button switch 7 (i.e., a button 71) is incorporated within the hose body 1, which will be described in greater detail below. The button switch 7 can be actuated and reset by the upwardly moving hose guide sleeve 2. The top pin 8 is slidably assembled in the lower guide sleeve 54. The top pin 8 is in contact with the lower end of the swing arm 6. The lower guide sleeve 54 is mounted with the elastic member 9 for driving the top pin 8 toward the swing arm 6.

In examples, the button switch 7 has an initial state and an actuated state. When the button switch 7 is in the initial state, the top pin 8 is separated from the hose body 1. When the button switch 7 is in the actuated state, the end of the top pin 8 is inserted into the hose body 1 and may prevent the hose guide sleeve 2 from falling down.

Figure 9:
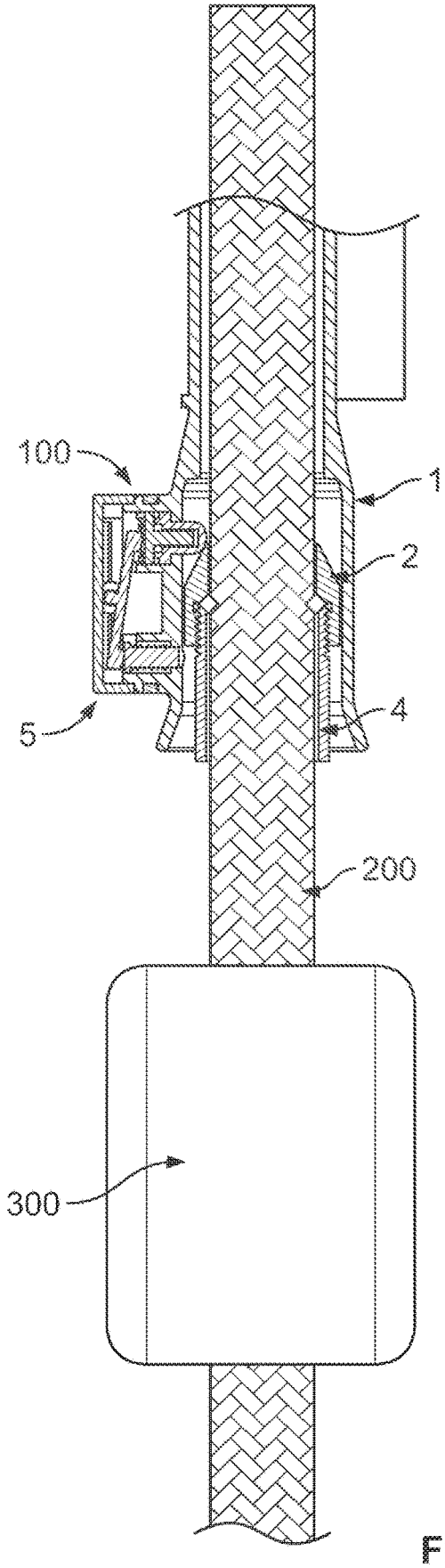
FIG. 9 is a section view of a hose drawing device.

An operating mechanism 100 of the present application may be used for an example faucet drawing out, pause operation of the water hose 200, further illustrated in FIG. 9.

The hose body 1 may be provided with the channel 11 such that the water hose 200 may pass through. The hose guide sleeve 2 is assembled in the channel 11 of the hose body 1 and can slide up and down in the channel 11. The lower end of the hose guide sleeve 2 may be coupled to a sleeve barrel 4, which is sleeved on the water hose 200. A snap ring 3 can be mounted at the connection between the sleeve barrel 4 and the hose guide sleeve 2, and the snap ring 3 may be used to clamp the water hose 200.

The swing arm 6 can be mounted in the mounting box 5 through a pivot shaft 61, wherein the pivot shaft 61 extends horizontally and the swing arm 6 may swing around the pivot shaft 61. The swing arm 6 can be assembled between the button switch 7 and the top pin 8. When the button switch 7 acts on the swing arm 6 to make it swing, the distance between the upper end of the swing arm 6 and the hose body 1 gradually increases and the distance between the lower end of the swing arm 6 and the hose body 1 gradually decreases, thereby driving the top pin 8 to extend toward the channel 11 of the hose body 1. As the top pin 8 acts on the swing arm 6 to make it swing, the distance between the lower end of the swing arm 6 and the hose body 1 gradually increases, and the distance between the upper end of the swing arm 6 and the hose body 1 gradually decreases, thereby driving the button switch 7 to reset.

The button switch 7 is fitted in the upper guide sleeve 53 in the way of clearance fit, and the button switch 7 may slide in the upper guide sleeve 53. One end of the button switch 7 is kept in contact with the upper end of the swing arm 6, and the other end of the button switch 7 is in the channel 11 of the hose body 1 so as to be able to be actuated by the upwardly moving hose guide sleeve 2.

The top pin 8 is assembled in the lower guide sleeve 54 with clearance and one end of the top pin 8 is kept in contact with the lower end of the swing arm 6. As the top pin 8 is driven by the swing arm 6 to slide toward the tube body 1, the opposing end of the top pin 8 may extend into the channel 11 to prevent the hose guide sleeve 2 from falling. In examples, the elastic member 9 can be assembled in the lower guide sleeve 54, which is used to drive the top pin 8 to move toward the swing arm 6, so that the other end of the top pin 8 leaves the channel 11.

In examples, as illustrated above, the button switch 7 has an initial state and an actuated state. In the initial state, the length of the button switch 7 extending into the channel 11 is longer than the length of the button switch 7 in the actuated state. The button switch 7 may be driven to slide toward the swing arm 6 by moving the hose guide sleeve 2 upward, wherein the hose guide sleeve 2 is moved in a first, upwardly motion (e.g., acting as a trigger or button-like feature) pressing the button switch, which activates the actuated state. In the actuated state, the length of the button switch 7 extending into the channel 11 is less than the length of the button switch 7 is extended into the channel 11 in the initial state, because the button switch 7 has been sliding toward the swing arm 6. In the actuated state, the button switch 7 slides toward the swing arm 6, which drives the swing arm 6 to rotate. After the swing arm 6 rotates to drive the top pin 8 to extend out into the channel 11, the button switch 7 remains in the actuated position so that the top pin 8 remains extended.

In the actuated state, the end of the button switch 7 still, at least partially, remains in the channel 11, such that the button switch 7 may be driven to slide toward the swing arm 6 by moving the hose guide sleeve 2 up again, wherein the hose guide sleeve 2 is moved in a second, upwardly motion (e.g., acting as a second trigger or button-like feature) to press the button switch an additional, second time. The button switch 7 no longer remains in the actuated position and the button switch 7 may be reset to the initial state. Thus, recalling, at least in part, the top pin 8 from the channel 11.

The lower end of the hose guide sleeve 2 will not exceed past the distance of the push button switch 7 each time the hose guide sleeve 2 is moved upward, which may prevent the end of the button switch 7 from extending into the channel 11 and from affecting the falling down of the hose guide sleeve 2.

In the initial state, the hose guide sleeve 2 is at a distance under the top pin 8. When the button switch 7 is in the initial state, the top pin 8 and the hose body 1 are in a separated state and the end of the top pin 8, facing the hose body 1, is received in the lower guide sleeve 54, which will not affect the upward movement of the hose guide sleeve 2.

In this example, the button switch 7 can be a button, for example, a button of a ballpoint pen, that can be pressed once to operate and pressed twice to reset. In examples, on the first press, the button switch 7 can be pressed down and, in the second press, the button switch 7 is reset.

With additional reference to FIG. 9, when the user needs to pull up the water hose 200, the hose guide sleeve 2 moves up and over the top pin 8, the hose guide sleeve 2 becomes in contact with the button switch 7 and presses the button switch 7. The button switch 7 slides toward the swing arm 6, which in turn drives the swing arm 6 to rotate and drives the end of the top pin 8 to extend into the channel 11. The button switch 7 remains in the actuated position and the top pin 8 remains extended. After the user releases the water hose 200, the water hose 200 drives the hose guide sleeve 2 to fall under the action of a weight 300, and the falling hose guide sleeve 2 is blocked by the top pin 8, thus making the water hose 200 stop falling and allowing the user to continue to use the faucet in the drawn out position.

When the user needs the water hose 200 to be reset, the water hose 200 can be pulled up again, which in turn moves upwardly the hose guide sleeve 2 and presses the button switch 7 again. Upon an additional activation, the button switch 7 no longer stays in the actuated position or leaves the actuated position, and no longer applies force to the swing arm 6. Under the action of the elastic member 9, the top pin 8 moves toward the swing arm 6, and the end of the top pin 8 leaves the channel 11. The top pin 8 drives the swing arm 6 to rotate, which in turn drives the button switch 7 to move toward the channel 11 and resets to the initial state. After the user releases the water hose 200, the falling hose guide sleeve 2, within the hose body 1 during the actuation state, is no longer blocked by the top pin 8, and the water hose 200 can fall and reset.

Therefore, the present disclosure provides an operating mechanism, in which a swing arm 6 is used for linkage between the button switch 7 and the top pin 8, which takes up a small space occupation, simple structure, and is easy to assemble.

In one of the examples, as shown in FIGS. 1 through 3 and FIGS. 5 through 8, the button switch 7 comprises a button 71 and a slide bar 72 slidingly connected to the button 71, wherein one end of the slide bar 72 is in contact with the upper end of the swing arm 6.

A limiting guide cylinder 55 having guide grooves 551 may be fixedly mounted in the upper guide sleeve 53 of the box body 51. The limiting guide cylinder 55 may have a limiting end face 552 on its end face toward the swing arm 6. In examples, the button 71 can have a ring gear 711 coupled to it. There may be one or more bumps 712 coupled about the circumference of the surface of the ring gear 711. There may be one or more toggle teeth 722 coupled to the slide bar 72 for toggling the ring gear 711 to rotate.

The button 71 may be in a clearance fit with the limiting guide cylinder 55, such that one end of the button 71 is in the hose body 1 and the one or more toggle teeth 722 engage with the ring gear 711 and may toggle the ring gear 711 to rotate. In examples, when the button switch 7 is in the initial state, the one or more bumps 712 may be fitted in the guide grooves 551 in the way of clearance fit. When the button switch 7 is in the actuated state, the one or more bumps 712 may leave the guide grooves 551, such that the one or more bumps 712 are blocked by the limiting end face 552.

In examples, the button switch 7 may comprise a button 71 and a slide bar 72, with one end of the slide bar 72 in contact with the upper end of the swing arm 6 and the opposing end of the slide bar 72 being slidingly coupled to the button 71. The button 71 may have a central hole 714 with an opening toward the swing arm 6. the opposing end of the button 71 may extend into the channel 11 having a hemispherical end 713. One end of the slide bar 72 may be fitted to be received in the central hole 714 in the way of clearance fit, and the axial clearance between the hemispherical end 713 and the central whole 714 can be adjusted according to the working conditions to meet the need of rotating the button 71.

One end of the button 71, facing the swing arm 6, may have a ring gear 711 with one or more ring gear teeth 7111 facing the swing arm 6. The one or more ring gear teeth 7111 may have a circular angle of a. The one or more bumps 712 on the circumference surface of the ring gear 711.

In examples, a limiting guide cylinder 55 may be fixedly mounted in the upper guide sleeve 53 and guide grooves 551 may extend along the axial direction are provided on the wall of the limiting guide cylinder 55. The one or more bumps 712 may be fitted in the guide grooves 551 in the way of clearance fit. The end face of the limiting guide cylinder 55 facing toward the swing arm 6 may be a limiting end face 552, which is used to block the bump 712 from leaving the guide grooves 551 to temporarily limit the button 71 so that the button switch 7 remains in the actuated position.

When the button switch 7 is in its initial state, the one or more bumps 712 may be fitted in the guide grooves 551 in the way of clearance fit and the button 71 can only slide axially and not rotate.

In examples, when the hose guide sleeve 2 moves up to drive the button 71, the sliding distance of the button 71 along the axial direction can be greater than the distance between the one or more bumps 712 in the guide grooves 551 and the limiting end face 552. In examples, the one or more bumps 712 can be disengaged from the guide grooves 551 and the button 71 can be rotated relative to the limiting guide cylinder 55.

In examples, when the button switch 7 is first actuated or pressed by the hose guide sleeve 2, the button switch 7 may be actuated, and the hose guide sleeve 2 moves up to drive the button 71 to act. Then, the slide bar 72 slides outwardly relative to the channel 11 and drives the swing arm 6 to swing, so that the top pin 8 extends into the channel 11. The one or more bumps 712 are removed from the guide grooves 551, while the ramp 7221 of the toggle teeth 722 act on the ring gear teeth 7111 to make the button 71 rotate. After the button 71 is turned a degree(s), the one or more bumps 712 may be no longer aligned with the guide grooves 551 but correspond to the limiting end face 552. After the button 71 is turned a degree(s), the toggle teeth 722 engage with the next ring gear teeth 7111, and the button 71 moves backward toward the channel 11. Thus, the one or more bumps 712, blocked by the limiting end face 552, keep the button switch 7 in the actuated position and keep the swing arm 6 against the top pin 8 so that its end remains in the channel 11 to prevent the hose guide sleeve 2 from falling.

In examples, when the button switch 7 is acted or pressed by the hose guide sleeve 2 for the second time, the button 71 may slide toward the swing arm 6 once again. The ramp 7221 of the toggle teeth 722 act on the ring gear teeth 7111 to make the button 71 rotate a degree(s) (again). The one or more bumps 712 leave the limit end 552 and align with the guide grooves 551. Then, the one or more bumps 712 may enter into the guide grooves 551. The button 71 may no longer hold the slide bar 72. In example, the top pin 8 may retract and rotate against the swing arm 6, under the action of the elastic member 9, and the button 71 slides toward the channel 11 to reset to the initial state.

In one of the examples, as shown in FIG. 2 and FIGS. 5 to 7, the limiting end face 552 may be in the form of a step, e.g., having a step like surface with the limited end face 552 configured as a step like surface, such that, when the button switch 7 is in the actuated state, the one or more bumps 712 may be blocked by the first limiting surface 5521. In examples, the first limiting face 5521 may be a concave surface of the step like surface and the distance between the first limiting face and the hose body 1 may be less than the distance between the second limiting face 5522 and the hose body 1. In examples, the central angle of the first limiting face 5521 may be greater than the central angle of the second limiting face 5522. The central angle of the first limiting face 5521 may be between $\alpha/2-\alpha$ and the central angle of the second limiting face 5522 may be less than $\alpha/2$, such as to ensure that the one or more bumps 712 can cross over the second limiting face 5522 and enter into the next guide groove 551 when the button 71 is pressed for the second time.

In examples, when the button switch 7 is in the actuated state, the one or more bumps 712 may be blocked by the first limiting face 5521, which may be a concave surface recessed toward the channel 11 and facilitate keeping the hemispherical end 713 of the button 71, at least partially, in the channel 11 so that it can be pressed or actuated by the hose guide sleeve 2 that moves up, again.

When the upwardly moving hose guide sleeve 2 presses or actuates the button 71 for the second time, the button 71 may be rotated under the action of the toggle teeth 722. The one or more bumps 712 cross over the second limiting face 5522 and enter into the next guide groove 551 and, thus, can be reset.

Figure 7:
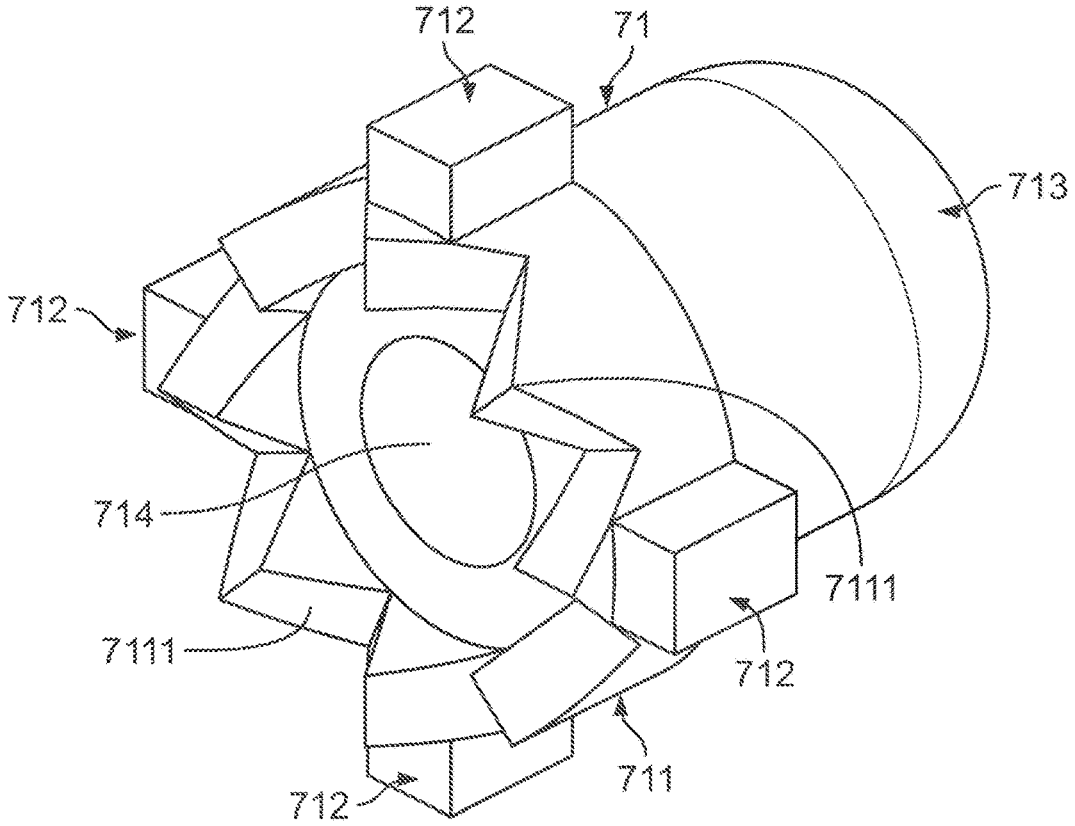
FIG. 7 is a perspective view of a button of a button switch.
Figure 8:
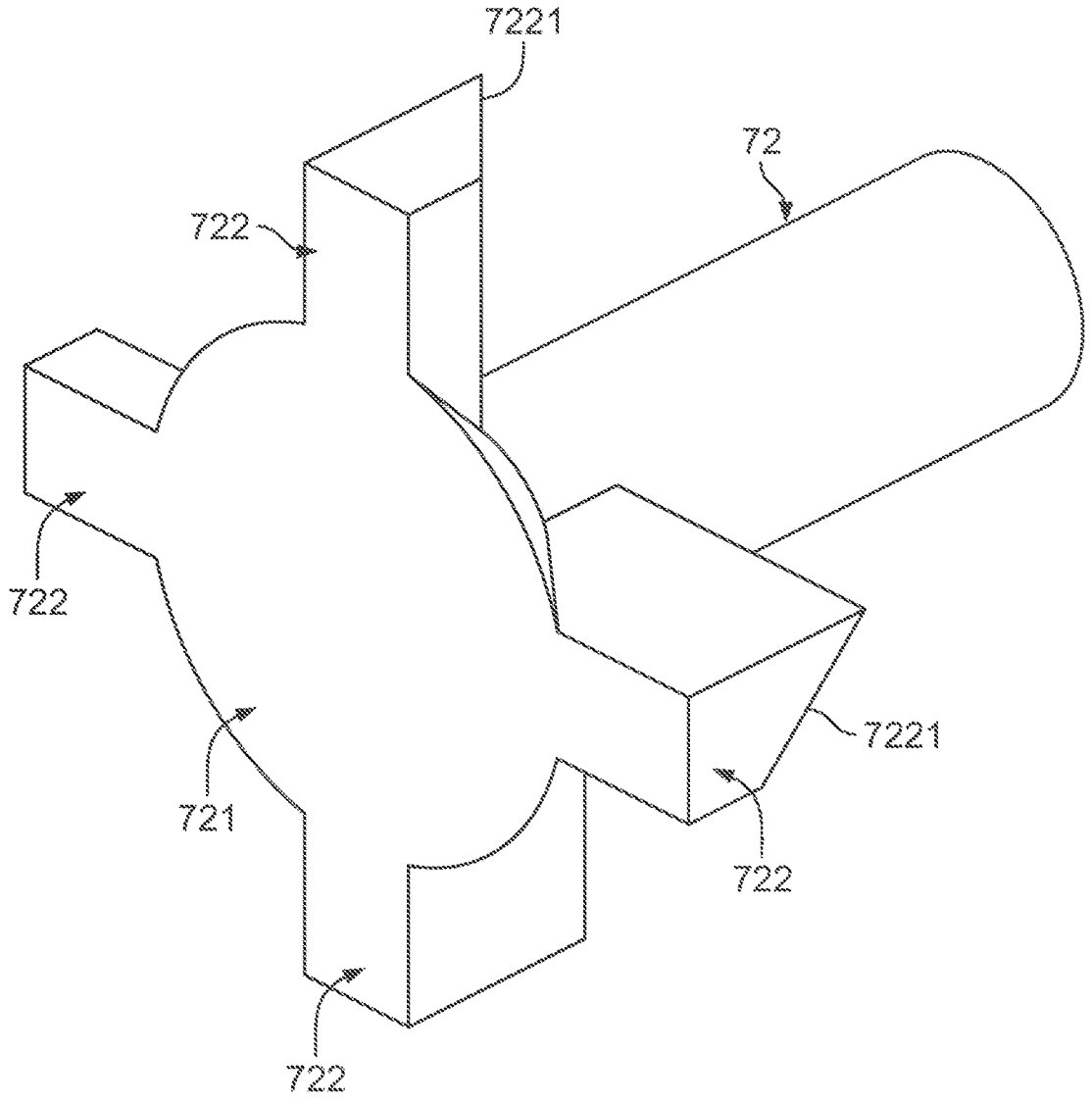
FIG. 8 is a perspective view of a slide bar of the button switch.

In one of the examples, as shown in FIGS. 2 and 8, the slide bar 72 has a slide bar plate 721 facing the end of the swing arm 6, and the toggle teeth 722 is set on the slide bar plate 721, which is in contact with the upper end of the swing arm 6. By configuring the slide bar plate 721, the contact area with the upper end of the swing arm 6 can be increased, which is conducive to improving the stability of the assembly. The toggle teeth 722 can be provided on the slide bar plate 721 and the toggle teeth 722 may extend toward the button 71. In one of the examples, as shown in FIGS. 7 and 8, the number of toggle teeth 722 can be n, and the ring gear 711 may have 2n ring gear teeth 7111, where n is a positive integer.

Figure 5:
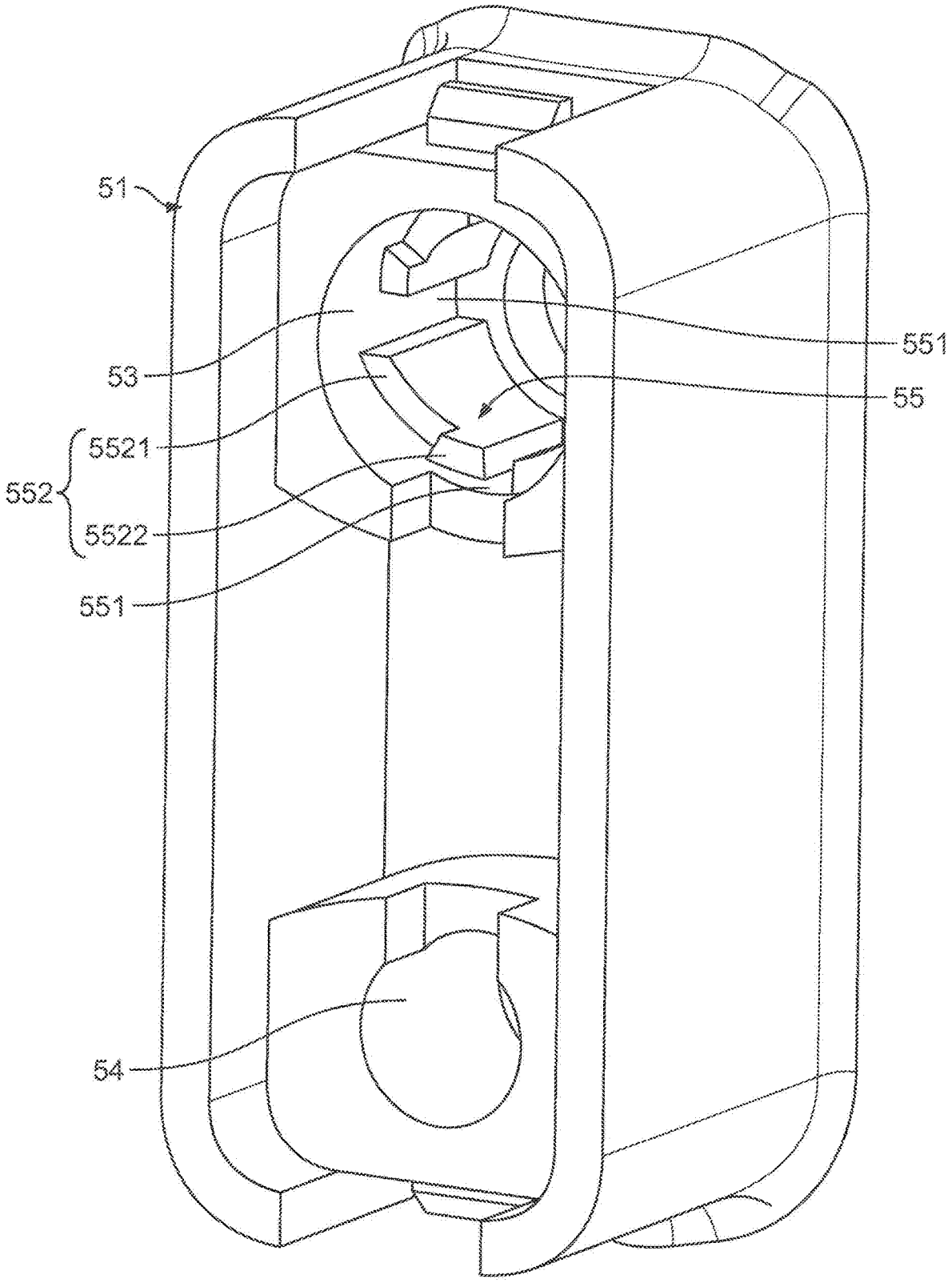
FIG. 5 is a perspective view of a box body of a mounting box.
Figure 6:
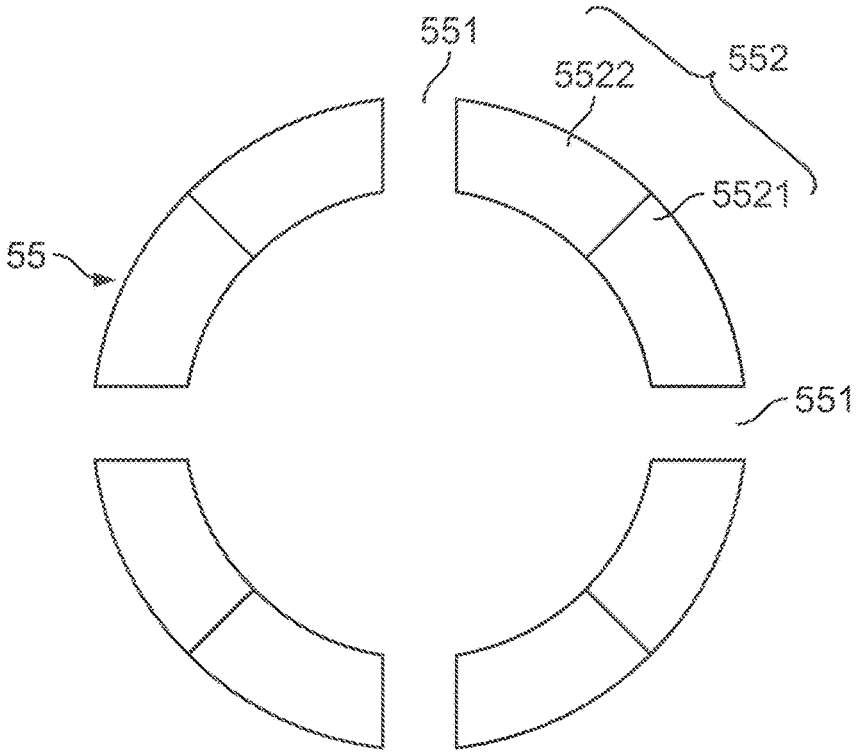
FIG. 6 is a schematic view of a limiting guide cylinder as viewed from a limiting end face.

In one of the examples, as shown in FIGS. 5 through 7, one or more bumps 712 can be evenly distributed on the circumference face of the ring gear 711, and accordingly, a plurality of guide grooves 551 are provided on the wall of the limiting guide cylinder 55. In examples, the number of bumps 712 can be equal to the number of guide grooves 551. When the button switch 7 is in the initial state, each of the one or more bumps 712 may be fitted in one guide groove 551 in the way of a clearance fit and, when the button 71 is pressed by the second time, each of the one or more bumps 712 may enter into the next guide groove 551, which improves the assembly stability of the button 71 and the limiting guide cylinder 55.

In one of the examples, as shown in FIGS. 1 and 2, the upper end of the hose guide sleeve 2 can have a tapered portion 21 for actuating the button switch 7. The radius of the tapered portion 21 may gradually decrease in the direction from bottom to top, which is beneficial for the hose guide sleeve 2 moving from bottom to top and to press or actuate the end of the button switch 7. When the button switch 7 is in the actuated position, the hose guide sleeve 2 may fall without being affected by the end of the button switch 7. At the second press or actuation of the button switch 7, the height of upward movement of the hose guide sleeve 2 may be greater than the height of the first upward movement, allowing its thicker roots to press or actuate the end of the button switch 7.

In one of the examples, as shown in FIG. 2, the upper end of the swing arm 6 is provided with an upper protrusion 62, and the upper protrusion 62 being in contact with the button switch 7. In examples, the lower end of the swing arm 6 is provided with a lower protrusion 63 and the lower protrusion 63 being in contact with the top pin 8. In examples, the sections of the upper protrusion 62 and the lower protrusion 63 may be, respectively, arc-shaped, so that the upper protrusion 62 can keep in contact with the end of the button switch 7 and the lower protrusion 63 can keep in contact with the end of the top pin 8 during the swing of the swing arm 6, which is conducive to improving the assembly stability.

In one of the examples, as shown in FIGS. 1 through 4, the mounting box 5 comprises a box body 51 connected with the hose body 1 and an end cap 52 attached to the box body 51. The upper guide sleeve 53 and the lower guide sleeve 54 are in the box body 51, and the swing arm 6 is mounted on the end cap 52 by a pivot shaft 61. In examples, the end cap 52 may be snap-fitted to the box body 51 through a snap, which facilitates assembly and disassembly for maintenance. In order to facilitate the snap-fitting, two connection snaps 521 may be mounted on the inner surface of the end cap 52 in a spaced arrangement. In examples, the section of the connection snaps 521 may be a superior arc. The pivot shaft 61 can be assembled in the connecting snaps 521 and the pivot shaft 61 can be rotated in the connecting snaps 521 to facilitate the assembly of the pivot shaft 61 with the end cap 52.

An operating mechanism 100 of the present application may be used for an example faucet drawing out, pause operation of the water hose 200, further illustrated in FIG. 9. An example of the present disclosure provides a hose drawing device comprising a water hose 200 and an operating mechanism 100 as described herein, with a hose guide sleeve 2 being sleeved on the water hose 200 and the water hose 200 passing through the hose body 1. Previous description of the operating mechanism 100, to understand the structure, construction and working principles of the above said operating mechanism 100, with reference to the water hose 200, will not be repeated for simplicity and clarity purposes.

In examples, the water hose 200 is provided with a weight 300. The hose guide sleeve 2, the snap ring 3 and the sleeve barrel 4 may be sleeved on the water hose 200, which passes through the channel 11 of the hose body 1. A faucet may be attached to the upper end of the water hose 200. In the initial state, the hose guide sleeve 2 is under the top pin 8.

In examples, when the user needs to pull up the water hose 200, the hose guide sleeve 2 moves up and over the top pin 8, the hose guide sleeve 2 is in contact with the button switch 7 and presses the button switch 7. The button switch 7 slides toward the swing arm 6, which in turn drives the swing arm 6 to rotate and drives the end of the top pin 8 into the channel 11. The button switch 7 remains in the actuated position and the top pin 8 remains extended. After the user releases the water hose 200, the water hose 200 drives the hose guide sleeve 2 to fall under the action of the weight 300, and the falling hose guide sleeve 2 is blocked by the top pin 8. Thus, forcing the water hose 200 to stop or cease from falling back into or through the channel 11, allowing the user to continue to use the faucet in the extended or actuated position.

In examples, when the user needs the water hose 200 to be reset, the water hose 200 is pulled up once again, forcing the hose guide sleeve 2 to lift upwardly and press the button switch 7 again. Thus, the button switch 7 no longer stays in the actuated position or leaves the actuated position and no longer applies a force to the swing arm 6. Under the action of the elastic member 9, the top pin 8 moves toward the swing arm 6 and the end of the top pin 8 leaves the channel 11. The top pin 8 drives the swing arm 6 to rotate, which drives the button switch 7 to move toward the channel 11 and resets to the initial state. After the user releases the water hose 200, the falling hose guide sleeve 2 is no longer blocked by the top pin 8 and the water hose 200 falls, which returns the hose guide sleeve 2 to its original position.

The foresaid individual technical solutions can be combined according to requirements, so as to achieve best technical effect.

The contents described above are only the principles and preferred examples of the present disclosure. It should be noted that, those skilled in the art can make various other modifications based on the principle of the present invention, all of which should be deemed to fall within the protection scope of the present invention.

It should be understood that the individual operations used in the methods of the present teachings may be performed in any order and/or simultaneously, as long as the teaching remains operable. Furthermore, it should be understood that the apparatus and methods of the present teachings can include any number, or all, of the described examples, as long as the teaching remains operable.

Various examples of systems, devices, and methods have been described herein. These examples are given only by way of example and are not intended to limit the scope of the claimed inventions. It should be appreciated, moreover, that the various features of the examples that have been described may be combined in various ways to produce numerous additional examples. Moreover, while various materials, dimensions, shapes, configurations and locations, etc. have been described for use with disclosed examples, others besides those disclosed may be utilized without exceeding the scope of this disclosure.

Persons of ordinary skill in the relevant arts will recognize that the subject matter hereof may comprise fewer features than illustrated in any individual example described above. The examples described herein are not meant to be an exhaustive presentation of the ways in which the various features of the subject matter hereof may be combined. Accordingly, the examples are not mutually exclusive combinations of features; rather, the various examples can comprise a combination of different individual features selected from different individual examples, as understood by persons of ordinary skill in the art. Moreover, elements described with respect to one example can be implemented in other examples even when not described in such examples unless otherwise noted.

Although a dependent claim may refer in the claims to a specific combination with one or more other claims, other examples can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An operating mechanism comprising:

a hose body defining a channel;

a hose guide sleeve movably positioned in the channel;

an upper guide sleeve in communication with the channel;

a lower guide sleeve in communication with the channel;

a button switch slidably positioned in the upper guide sleeve, wherein the button switch is configured to engage the hose guide sleeve in the channel and to transition between an initial state and an actuated state via movement of the hose guide sleeve in the channel;

a blocking pin slidably positioned in the lower guide sleeve; and a swing arm operably coupled to the button switch and the blocking pin, wherein the button switch is configured to exert a force on the swing arm when transitioning from the initial state to the actuated state to cause the swing arm to move the blocking pin into the channel.

2. The operating mechanism of claim 1, wherein the button switch is configured to transition between the initial state and the actuated state via movement of the hose guide sleeve in a first direction, wherein the blocking pin is configured to engage the hose guide sleeve in the channel when the button switch is in the actuated state, thereby limiting movement of the hose guide sleeve in a second direction opposite the first direction.

3. The operating mechanism of claim 1, wherein the blocking pin is configured to retract into the lower guide sleeve when the button switch is in the initial state.

4. The operating mechanism of claim 3, wherein an elastic member positioned in the lower guide sleeve is configured to bias the blocking pin away from the channel and toward the swing arm when the button switch is in the initial state.

5. The operating mechanism of claim 1, wherein the button switch is configured to transition from the initial state to the actuated state via a first movement of the hose guide sleeve in the channel and remain in the actuated state until a second movement of the hose guide sleeve in the channel in a same direction as the first movement, wherein the button switch is configured to transition from the actuated state to the initial state via the second movement.

6. The operating mechanism of claim 1, wherein the button switch comprises a button and a slide bar slidingly connected to the button, wherein the slide bar defines a first end of the button switch configured to engage the swing arm, and wherein the button defines a second end of the button switch extending into the channel and configured to engage the hose guide sleeve.

7. The operating mechanism of claim 6, wherein the upper guide sleeve comprises a guide cylinder having a guide groove and an end face oriented toward the swing arm;

wherein the button comprises a ring gear having a bump on a circumferential surface;

wherein the slide bar comprises toggle teeth configured to engage the ring gear for toggling the ring gear to rotate when transitioning between the initial state and the actuated state; and wherein, when the button switch is in the initial state, the bump is slidably positioned in the guide groove to allow movement of the button in the upper guide sleeve, and when the button switch is in the actuated state, the bump is configured to engage the end face to limit movement of the button in the upper guide sleeve.

8. The operating mechanism of claim 7, wherein the end face of the guide cylinder is stepped and comprises a first face and a second face, wherein a distance between the first face and the hose body is shorter than a distance between the second face and the hose body, and wherein the bump is configured to engage the first face when the button switch is in the actuated state.

9. The operating mechanism of claim 7, wherein the slide bar comprises a slide bar plate configured to engage the swing arm, and wherein the toggle teeth are positioned on the slide bar plate.

10. The operating mechanism of claim 7, wherein the bump comprises multiple bumps arranged circumferentially about the circumferential surface of the ring gear, wherein the guide groove comprises multiple guide grooves arranged circumferentially about the guide cylinder, and wherein each guide groove is configured to receive one of the bumps.

11. The operating mechanism of claim 1, wherein an upper end of the hose guide sleeve configured to engage the button switch in the channel has a tapered profile.

12. The operating mechanism of claim 1, further comprising a mounting box mounted on an outside surface of the hose body, wherein the mounting box includes the upper guide sleeve and the lower guide sleeve, and wherein the swing arm is pivotably mounted in the mounting box.

13. The operating mechanism of claim 12, wherein the mounting box comprises a box body connected to the hose body and an end cap connected to the box body, wherein the upper guide sleeve and the lower guide sleeve are defined in the box body, and wherein the swing arm is pivotably mounted on the end cap via a pivot shaft.

14. A hose drawing device comprising:

a water hose; and an operating mechanism coupled to the water hose, wherein the operating mechanism comprises:

a hose body defining a channel, wherein the water hose extends through the channel;

a hose guide sleeve coupled to the water hose in the channel and movable with the water hose in the channel;

an upper guide sleeve in communication with the channel;

a lower guide sleeve in communication with the channel;

a button switch slidably positioned in the upper guide sleeve, wherein the button switch is configured to engage the hose guide sleeve in the channel;

a blocking pin slidably positioned in the lower guide sleeve; and a swing arm operably coupled to the button switch and the blocking pin;

wherein the button switch is configured to transition between an initial state and an actuated state via movement of the water hose and the hose guide sleeve in the channel; and wherein the swing arm is configured to move the blocking pin into the channel via the button switch transitioning from the initial state to the actuated state.

15. The hose drawing device of claim 14, wherein the button switch is configured to transition between the initial state and the actuated state via movement of the water hose and the hose guide sleeve in a first direction, wherein the blocking pin is configured to engage the hose guide sleeve in the channel when the button switch is in the actuated state, thereby limiting movement of the water hose and the hose guide sleeve in a second direction opposite the first direction.

16. The hose drawing device of claim 14, wherein the blocking pin is configured to retract into the lower guide sleeve when the button switch is in the initial state, and wherein an elastic member positioned in the lower guide sleeve is configured to bias the blocking pin away from the channel and toward the swing arm when the button switch is in the initial state.

17. The hose drawing device of claim 14, wherein the button switch is configured to transition from the initial state to the actuated state via a first movement of the hose guide sleeve and the water hose in the channel and remain in the actuated state until a second movement of the hose guide sleeve and the water hose in the channel in a same direction as the first movement, wherein the button switch is configured to transition from the actuated state to the initial state via the second movement.

18. The hose drawing device of claim 14, wherein the button switch comprises a button and a slide bar slidingly connected to the button, wherein the slide bar defines a first end of the button switch configured to engage the swing arm, and wherein the button defines a second end of the button switch extending into the channel and configured to engage the hose guide sleeve.

19. The hose drawing device of claim 18, wherein the upper guide sleeve comprises a guide cylinder having a guide groove and an end face oriented toward the swing arm;

wherein the button comprises a ring gear having a bump on a circumferential surface;

wherein the slide bar comprises toggle teeth configured to engage the ring gear for toggling the ring gear to rotate when transitioning between the initial state and the actuated state; and wherein, when the button switch is in the initial state, the bump is slidably positioned in the guide groove to allow movement of the button in the upper guide sleeve, and when the button switch is in the actuated state, the bump is configured to engage the end face to limit movement of the button in the upper guide sleeve.

* * * * *